US011835237B2

(12) United States Patent
Todd et al.

(10) Patent No.: US 11,835,237 B2
(45) Date of Patent: Dec. 5, 2023

(54) OVEN APPLIANCE AND DOOR ASSEMBLY

(71) Applicant: Haier US Appliance Solutions, Inc., Wilmington, DE (US)

(72) Inventors: Justin Patrick Todd, Louisville, KY (US); Olaf Lopez, Querétaro (MX)

(73) Assignee: Haier US Appliance Solutions, Inc., Wilmington, DE (US)

( * ) Notice: Subject to any disclaimer, the term of this patent is extended or adjusted under 35 U.S.C. 154(b) by 77 days.

(21) Appl. No.: 17/344,290

(22) Filed: Jun. 10, 2021

(65) Prior Publication Data

US 2022/0397281 A1 Dec. 15, 2022

(51) Int. Cl.
*F24C 15/04* (2006.01)
*F24C 15/02* (2006.01)

(52) U.S. Cl.
CPC ..... *F24C 15/04* (2013.01); *F24C 15/024* (2013.01); *F24C 15/02* (2013.01); *F24C 15/045* (2013.01)

(58) Field of Classification Search
CPC ..... F24C 15/04; F24C 15/24; F24C 15/02; F24C 15/045
USPC ..... 126/200
See application file for complete search history.

(56) References Cited

U.S. PATENT DOCUMENTS 4,827,902 A * 5/1989 Rinker ..... F24B 1/192 126/190
5,819,722 A * 10/1998 Katz ..... F24C 15/006 126/200
9,347,674 B2 5/2016 Edwards
2010/0193499 A1* 8/2010 Blazevich ..... F24C 15/02 219/394

FOREIGN PATENT DOCUMENTS

EP 2141417 A2 1/2010
EP 3299723 A1 * 3/2018 ..... F24C 15/045
GB 19097071 A * 3/1909
JP 2008224082 A 9/2008

* cited by examiner

*Primary Examiner* — Steven B McAllister
*Assistant Examiner* — Benjamin W Johnson
(74) *Attorney, Agent, or Firm* — Dority & Manning, P.A.

(57) ABSTRACT

An oven appliance may include a cabinet and a door assembly. The cabinet may define a cooking chamber. The door assembly may be movably mounted to the cabinet to selectively restrict access to the cooking chamber. The door assembly may extend laterally between a first side and a second side. The door assembly may include a support frame and a front glass panel. The support frame may include a front bezel directed forward away from the cooking chamber. The front glass panel may be mounted to the support frame behind the front bezel, the front glass panel defining an exposed edge along the first side.

7 Claims, 10 Drawing Sheets

OVEN APPLIANCE AND DOOR ASSEMBLY

FIELD OF THE INVENTION

The present subject matter relates generally to residential oven appliances and more particularly to door assemblies for an oven appliance.

BACKGROUND OF THE INVENTION

Conventional residential and commercial oven appliances generally include a cabinet that defines a cooking chamber for receipt of food items for cooking. Multiple gas or electric heating elements may be positioned within the cabinet for heating the cooking chamber to cook food items located therein. The heating elements can include, for example, a bake heating assembly positioned at a bottom of the cooking chamber and a separate broiler heating assembly positioned at a top of the cooking chamber. A door or door assembly is often provided to selectively cover the opening to the cooking chamber. In some cases, multiple doors may be provided, such as to cover separate cooking chambers defined by the cabinet.

In common oven appliances, a glass (e.g., transparent ceramic or glass ceramic) panel is included with the door to permit a user to see through the door and into the corresponding cooking chamber. Typically, such panels are disposed on a frame that forms a circumferential bezel that defines an enclosed hole that is covered by the glass panel. Together, the circumferential bezel and a portion of the glass panel may form the front or outer surface of the door.

In spite of the current existing oven door configurations, it may be desirable for at least a portion of the outer surface of a door to fully extend to an edge of the door (e.g., without bending or wrapping around an inner portion of the frame). This may be especially desirable with multi-door configurations, such as when two doors are positioned side-by-side. Current configurations necessitate a disjointed appearance, wherein the circumferential bezel of each door interrupts the glass panels of the doors. Nonetheless, it may be more visually appealing if multiple doors can create a seamless appearance for the glass panels of the multiple doors. Not only may be appearance be preferable to existing oven doors, but such doors may be easier to clean and reduce the surfaces that can inadvertently catch or snag (e.g., a user's clothing). However, simply removing portions of a circumferential bezel may result in a glass panel being inadequately supported or susceptible to damage.

As a result, further improvements for oven doors may be desirable. In particular, it would be advantageous to provide one or more oven doors having a glass panel extending to at least an edge of the corresponding door (e.g., while fully supporting the glass panel or otherwise maintaining durability of the door).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an oven appliance is provided. The oven appliance may include a cabinet and a door assembly. The cabinet may define a cooking chamber. The door assembly may be movably mounted to the cabinet to selectively restrict access to the cooking chamber. The door assembly may extend laterally between a first side and a second side. The door assembly may include a support frame and a front glass panel. The support frame may include a front bezel directed forward away from the cooking chamber. The front glass panel may be mounted to the support frame behind the front bezel, the front glass panel defining an exposed edge along the first side.

In another exemplary aspect of the present disclosure, an oven appliance is provided. The oven appliance may include a cabinet, a first door assembly, and a second door assembly. The cabinet may define a first cooking chamber and a second cooking chamber spaced apart from the first cooking chamber. The first door assembly may be movably mounted to the cabinet to selectively restrict access to the first cooking chamber. The first door assembly may extend between an inner side and an outer side. The first door assembly may include a support frame and a front glass panel. The support frame of the first door assembly may include a front bezel directed forward away from the first and second cooking chambers. The front glass panel of the first door assembly may be mounted to the support frame behind the front bezel of the first door assembly. The front glass panel of the first door assembly may define an exposed edge along the inner side of the first door assembly. The second door assembly may be movably mounted to the cabinet to selectively restrict access to the second cooking chamber. The second door assembly may extend between an inner side and an outer side. The inner side of the second door assembly may be disposed proximal and parallel to the inner side of the first door assembly. The second door assembly may include a support frame and a front glass panel. The support frame of the second door assembly may include front bezel directed forward away from the first and second cooking chambers. The front glass panel of the second door assembly may be mounted to the support frame behind the front bezel of the second door assembly. The front glass panel of the second door assembly may an exposed edge along the inner side of the second door assembly.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
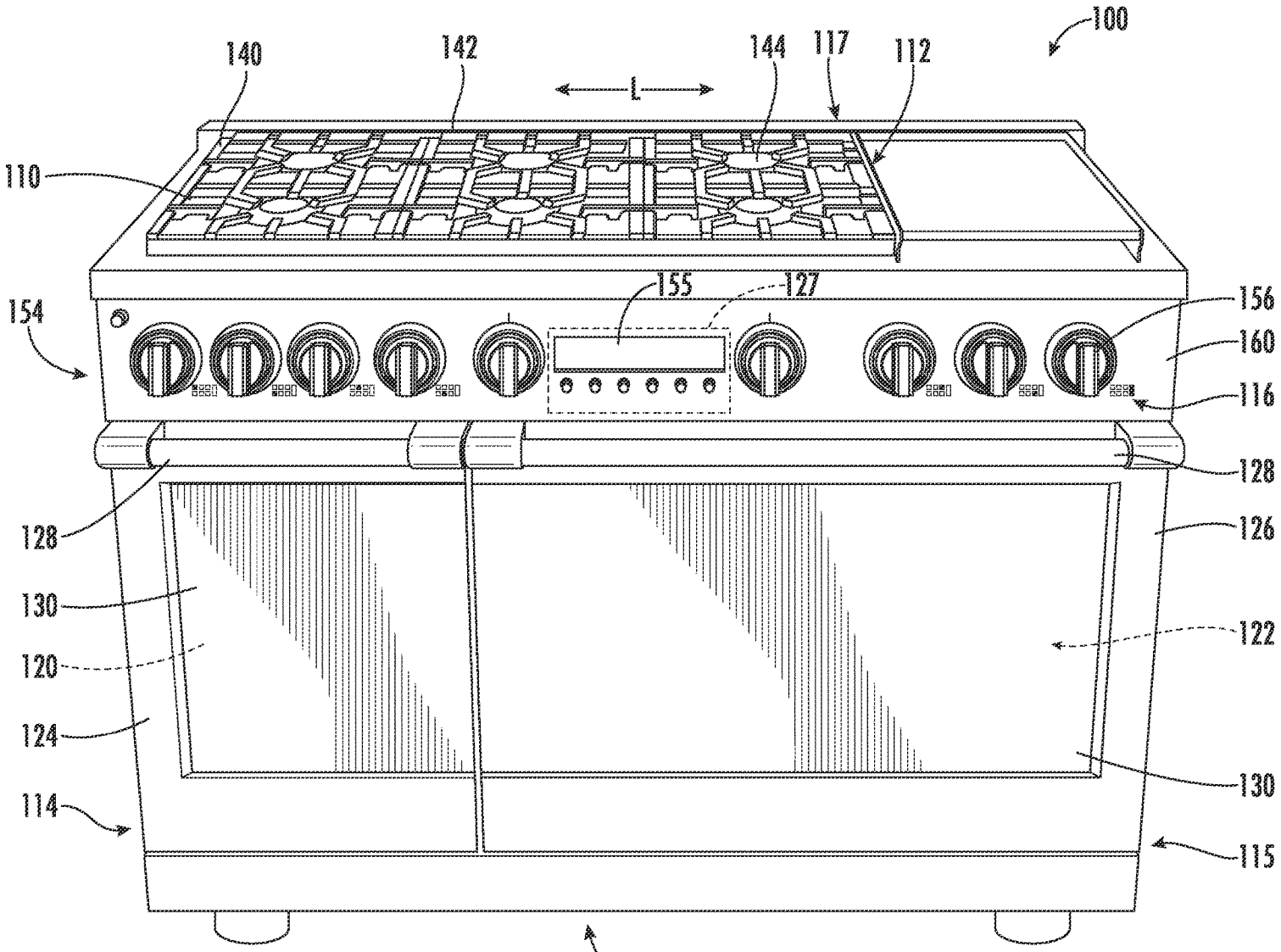
FIG. 1 provides a perspective view of an oven appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). The terms "coupled," "fixed," "attached to," and the like refer to both direct coupling, fixing, or attaching, as well as indirect coupling, fixing, or attaching through one or more intermediate components or features, unless otherwise specified herein. Terms such as "left," "right," "front," "back," "top," or "bottom" are used with reference to the perspective of a user accessing the oven appliance. For example, a user stands in front of the oven to open the doors and reaches into the cooking chamber(s) to access items therein.

Figure 2:
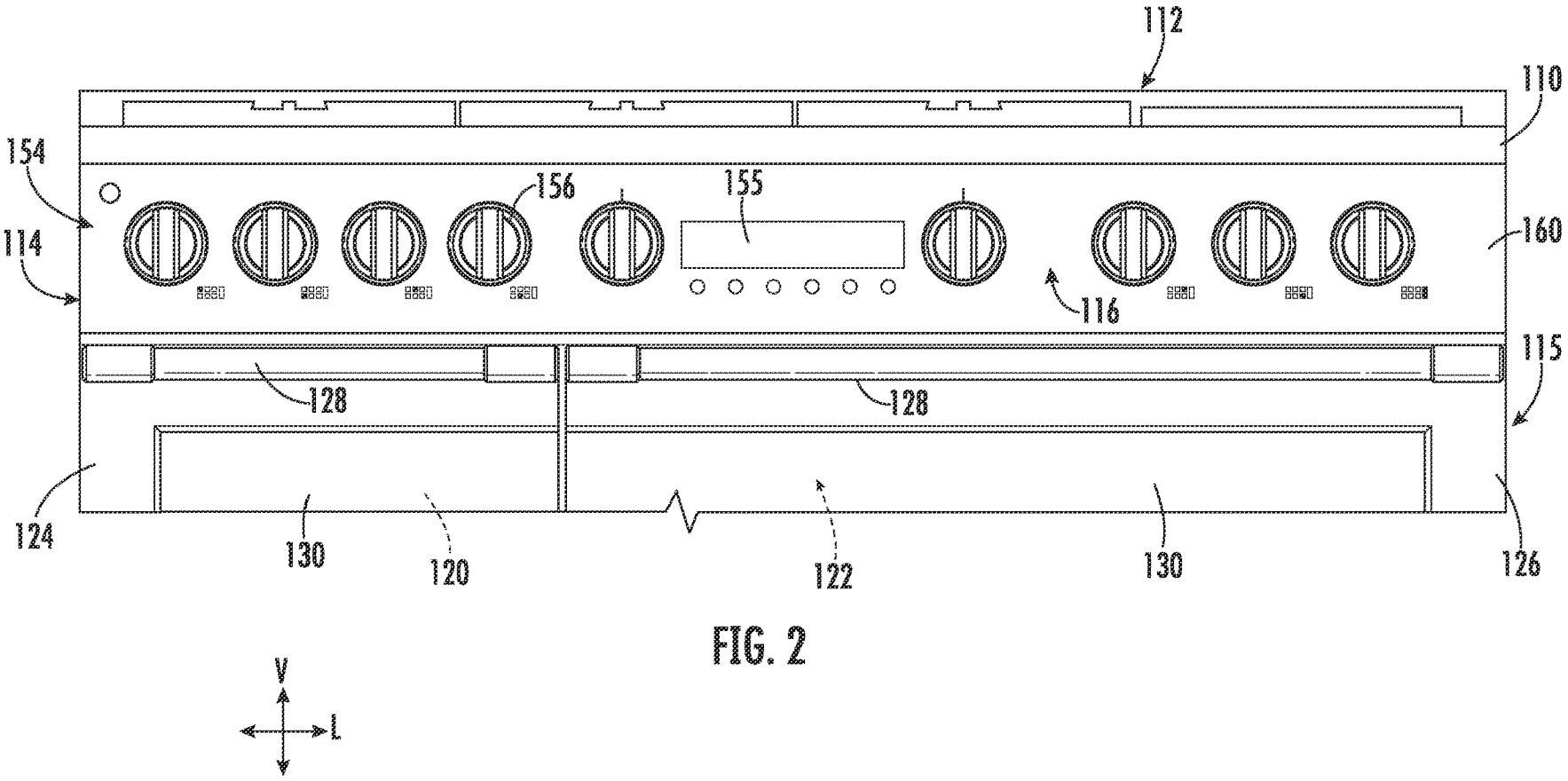
FIG. 2 provides a front elevation view of a portion of the exemplary oven appliance of FIG. 1.
Figure 3:
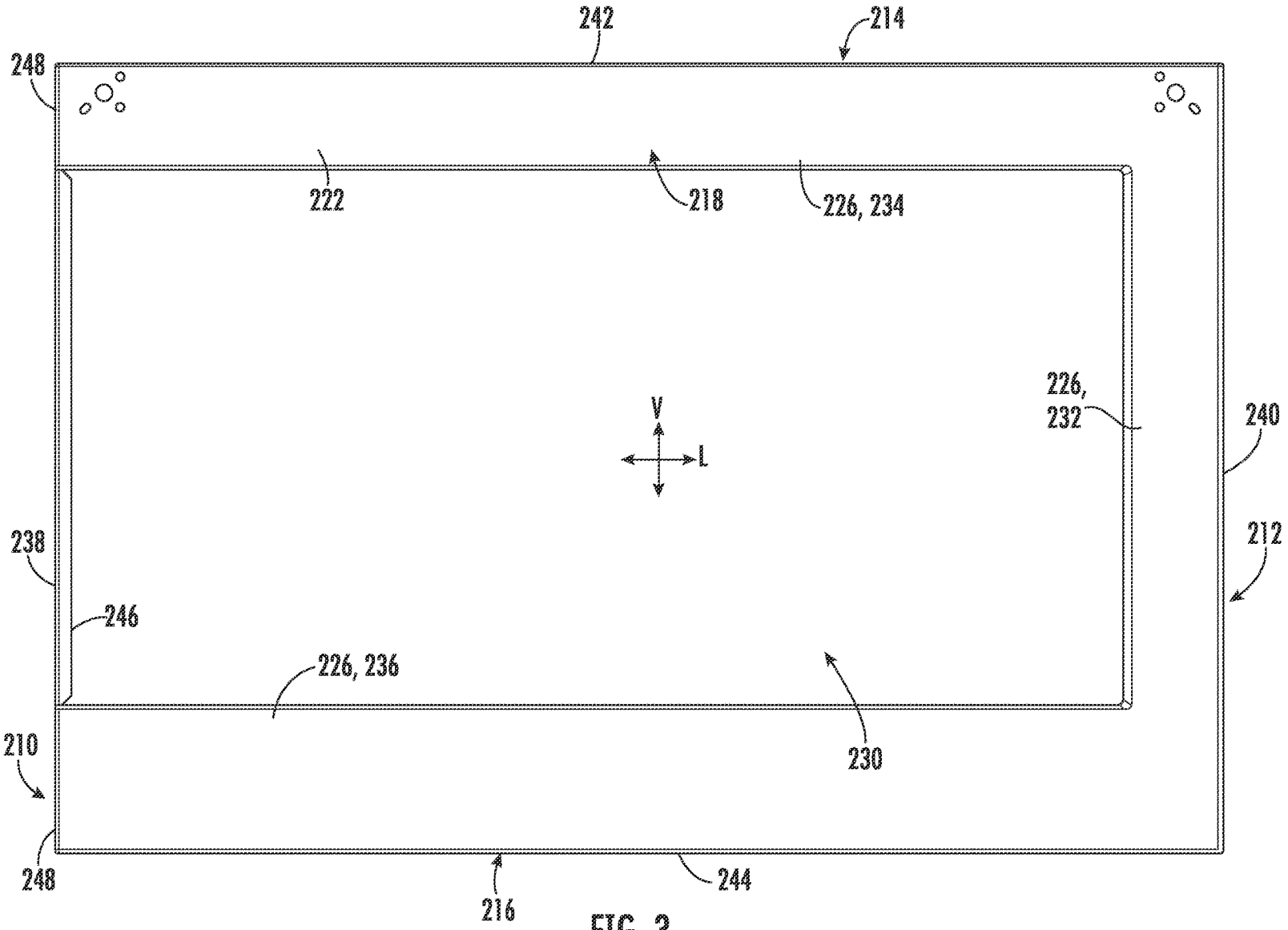
FIG. 3 provides a front elevation view of a portion of a frame of one door of the exemplary oven appliance of FIG. 1.
Figure 4:
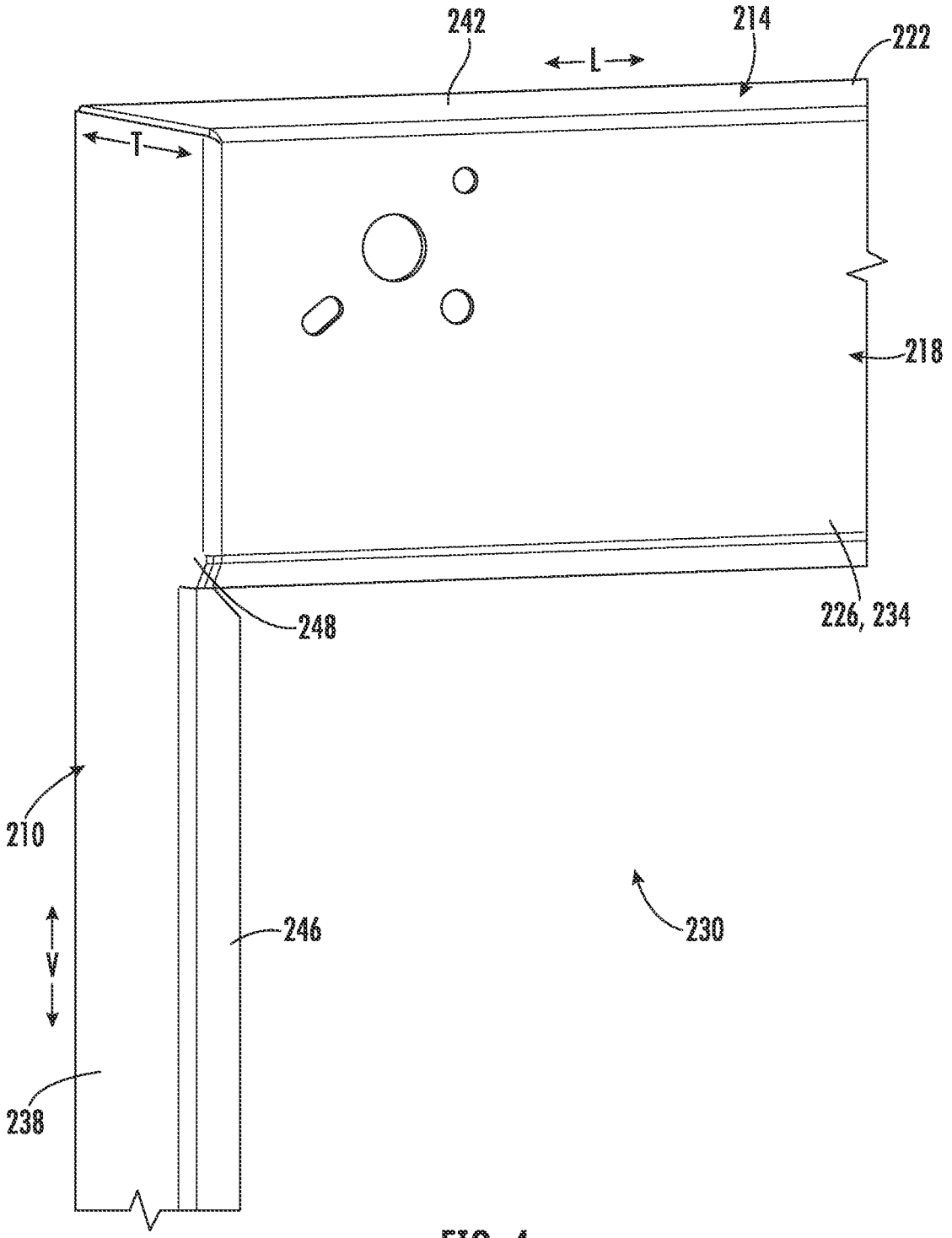
FIG. 4 provides a front perspective view of a top portion of the exemplary frame of FIG. 3.
Figure 5:
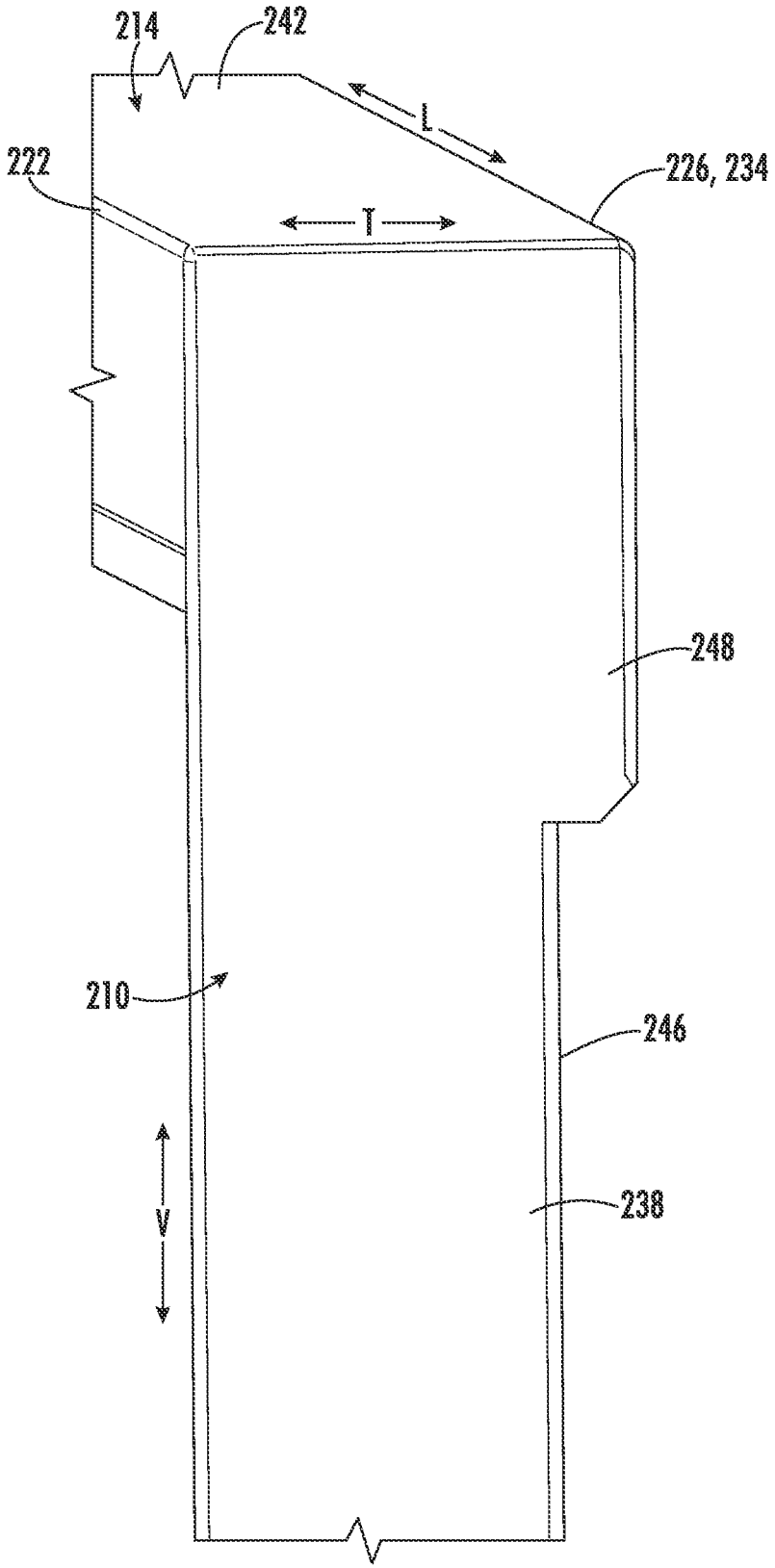
FIG. 5 provides a rear perspective view of a top portion of the exemplary frame of FIG. 3.
Figure 6:
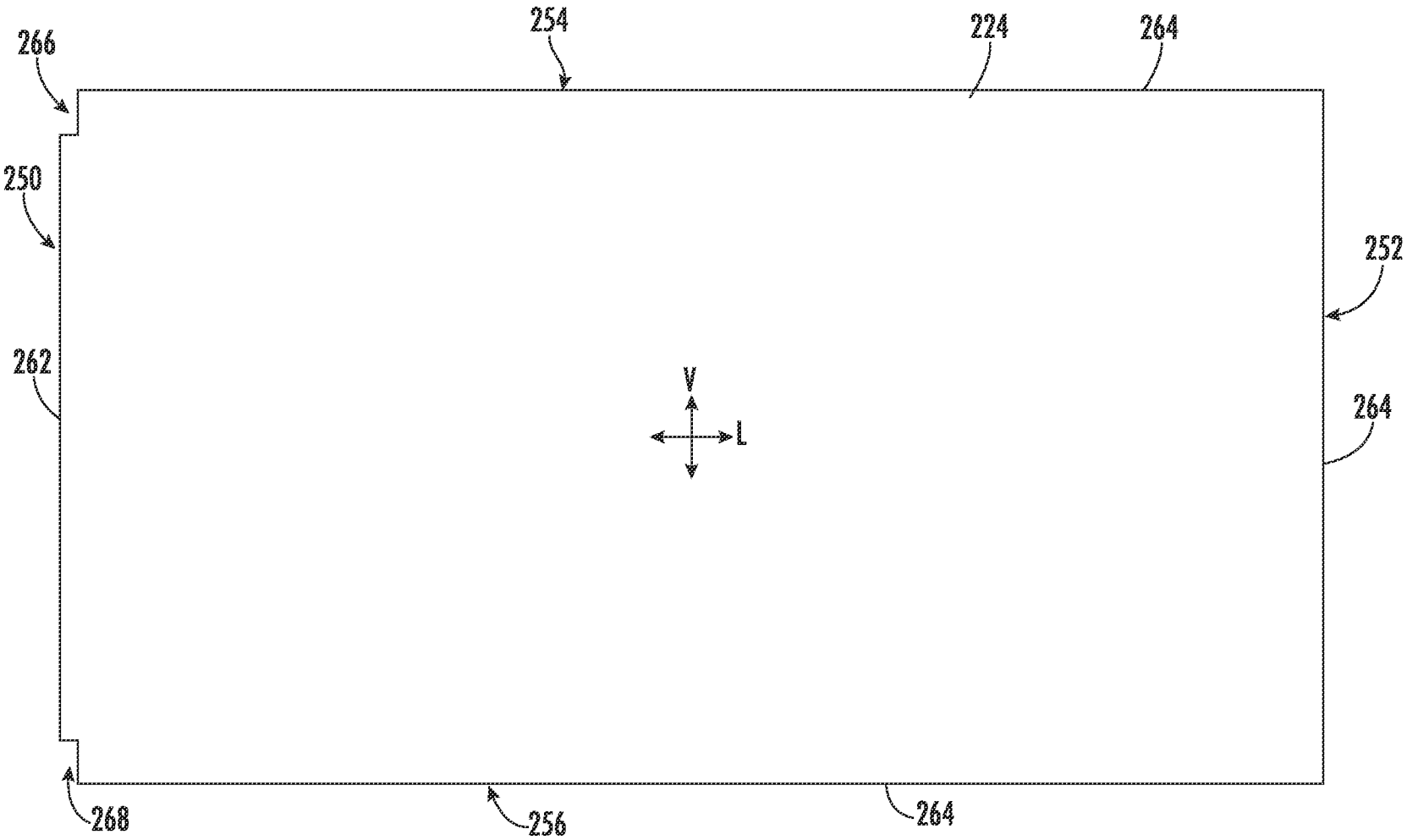
FIG. 6 provides a front elevation view of a glass panel of one door of the exemplary oven appliance of FIG. 1.
Figure 7:
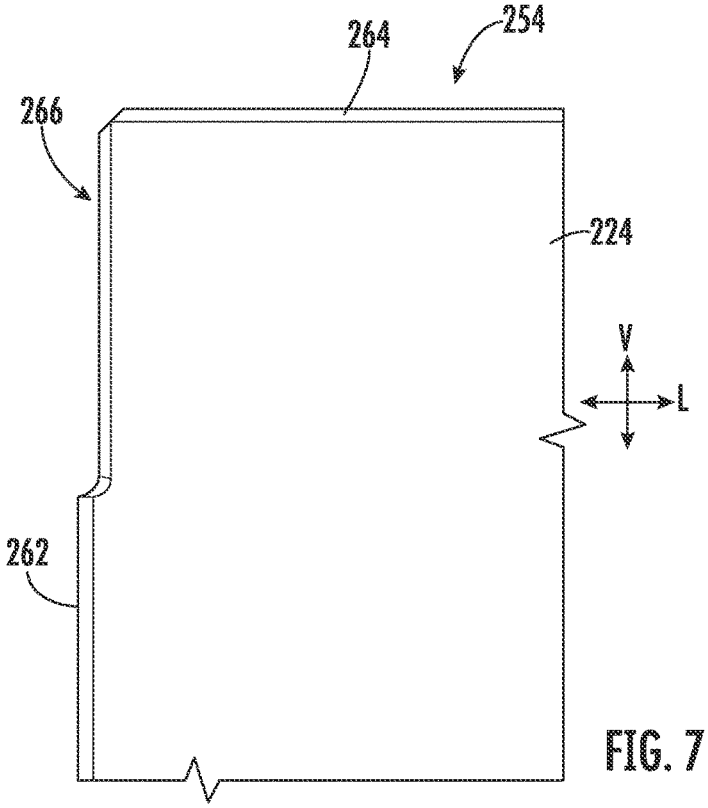
FIG. 7 provides a front elevation view of a top portion of the exemplary frame of FIG. 6.
Figure 8:
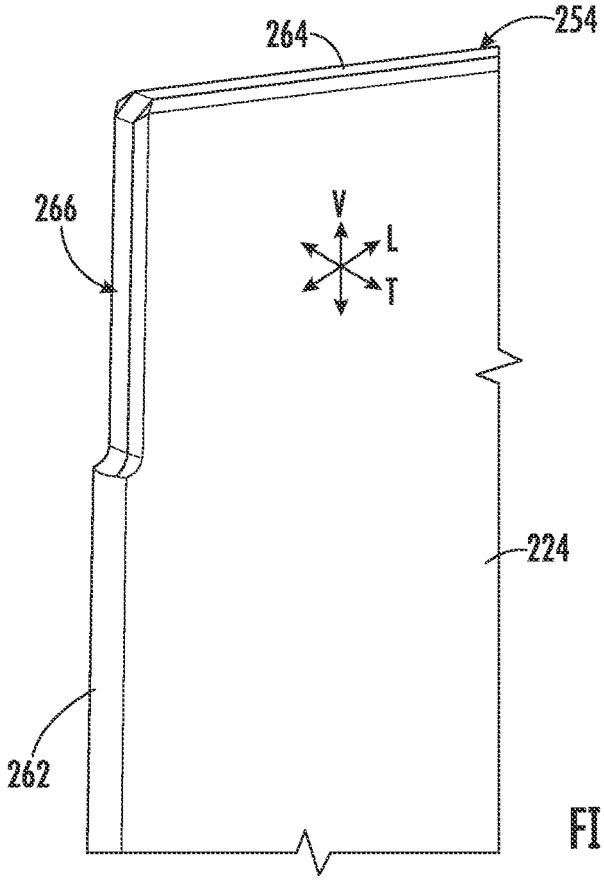
FIG. 8 provides a front perspective view of a top portion of the exemplary frame of FIG. 6.
Figure 9:
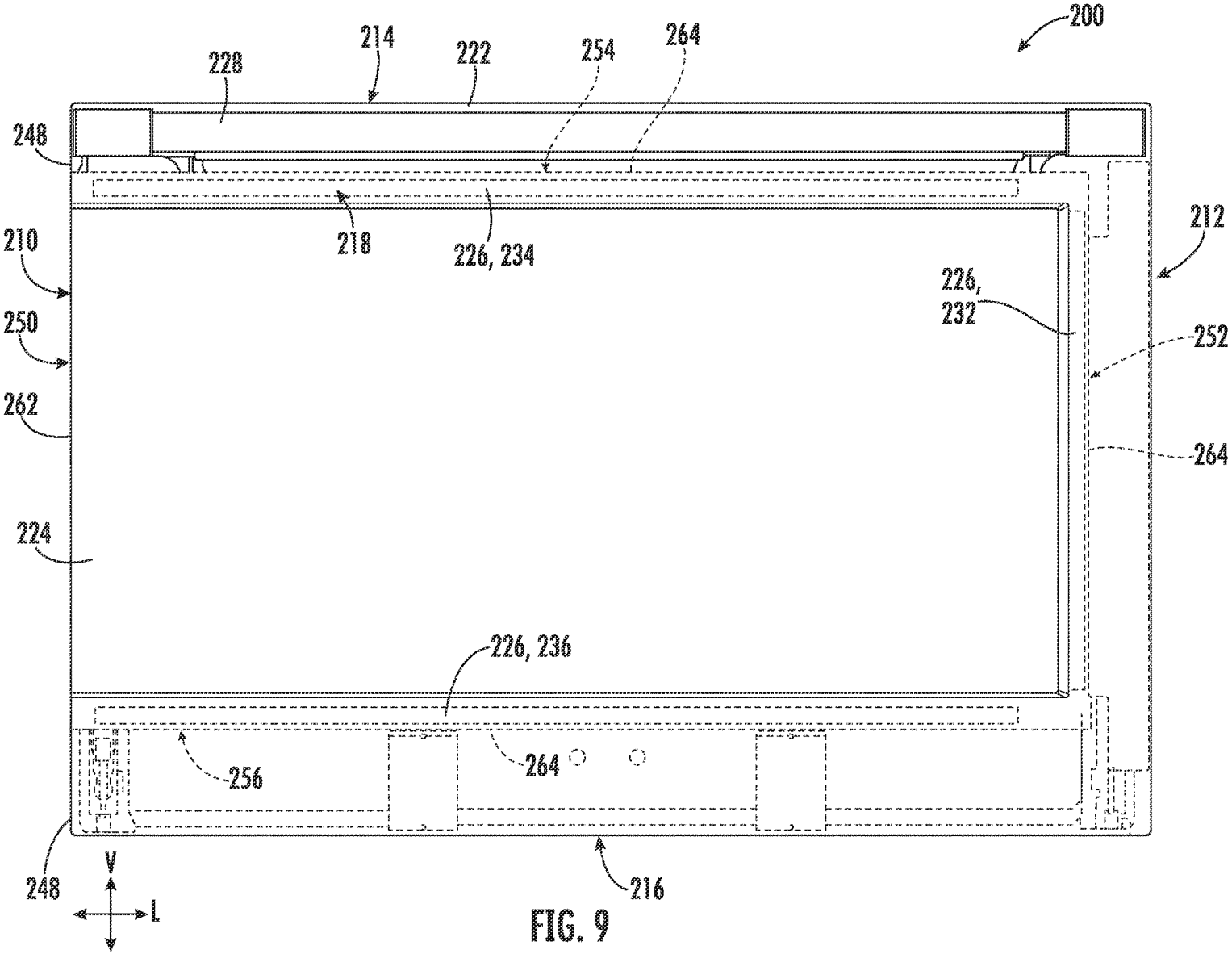
FIG. 9 provides a front elevation view of one door the exemplary oven appliance of FIG. 1.
Figure 10:
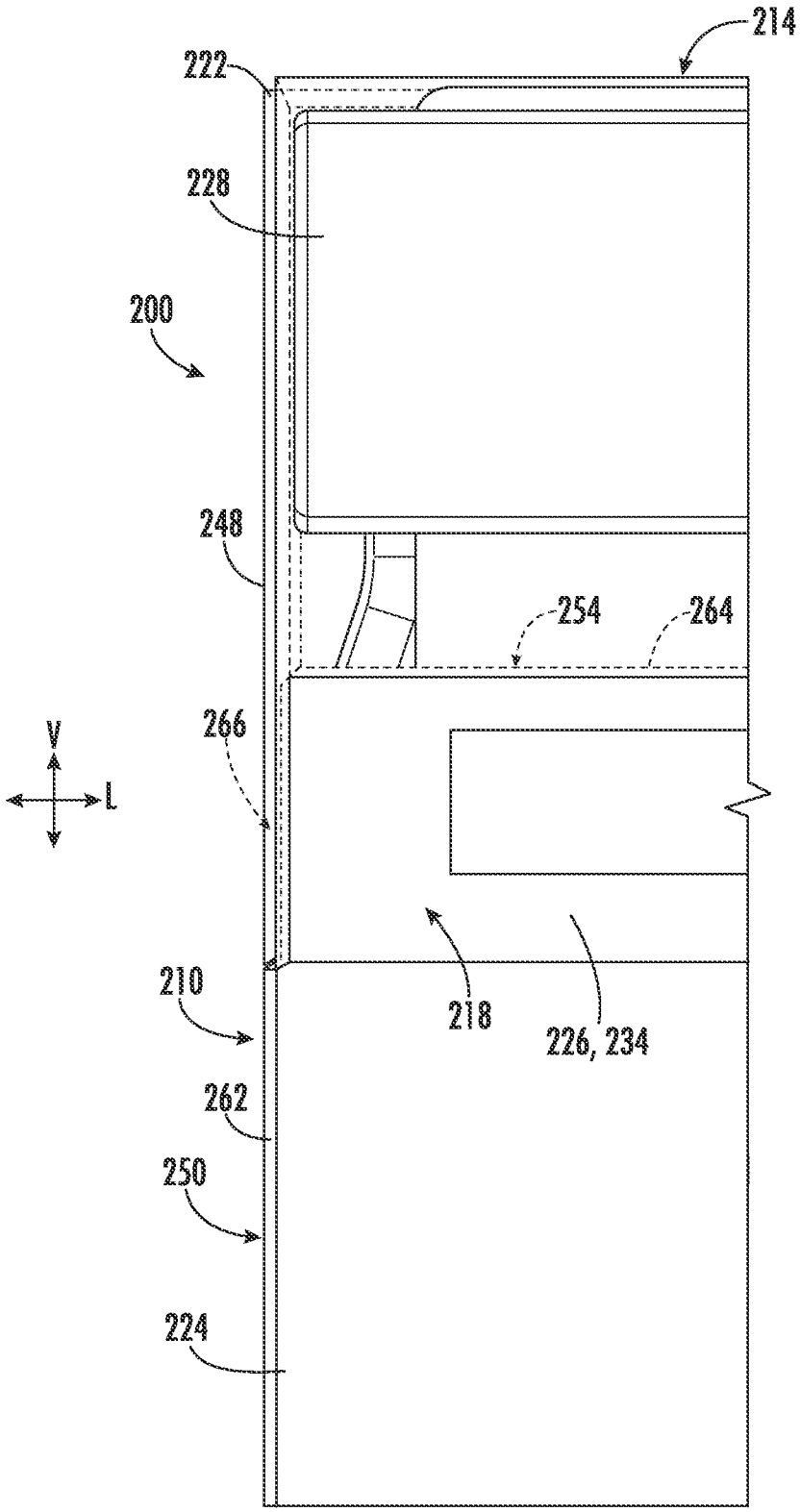
FIG. 10 provides a front elevation view of a top portion of the exemplary door of FIG. 9.
Figure 11:
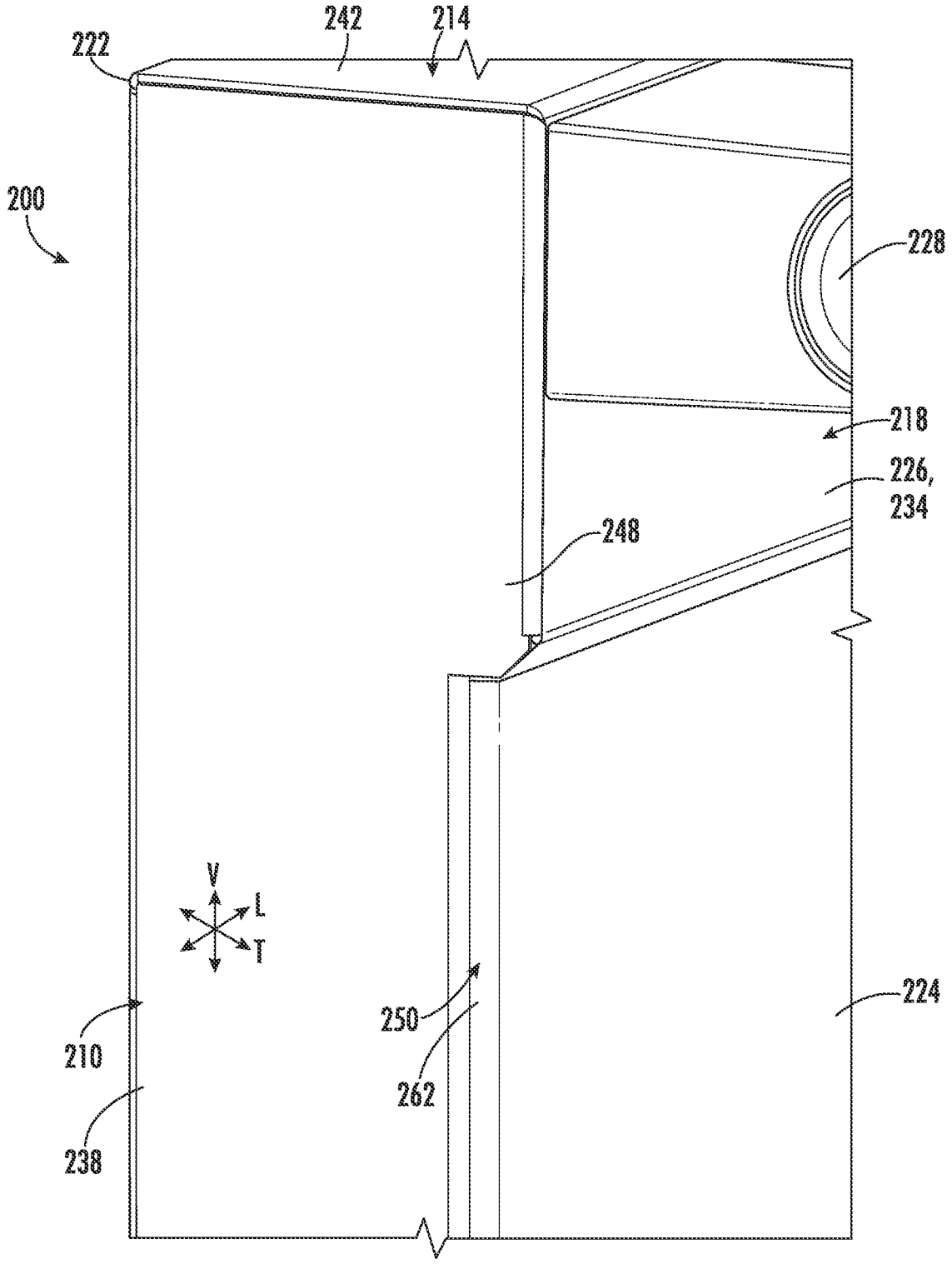
FIG. 11 provides a front perspective view of a top portion of the exemplary door of FIG. 9.

Turning now to the figures, FIG. 1 provides a front, perspective view of an oven or cooking appliance 100 as may be employed with the present disclosure. FIG. 2 provides an elevation view of a top portion or region of oven appliance 100. Cooking appliance 100 includes an insulated cabinet housing or cabinet 110. As shown, cooking appliance 100 defines a vertical direction V, a lateral direction L, and a transverse direction T (e.g., at cabinet 110). The vertical direction V, lateral direction L, and transverse direction T are mutually perpendicular and form an orthogonal direction system.

Cabinet 110 generally configured for containing or supporting various components of appliance 100 and which may also define one or more internal chambers or compartments of appliance 100. In this regard, as used herein, the terms "cabinet," "housing," and the like are generally intended to refer to an outer frame or support structure for appliance 100 (e.g., including any suitable number, type, and configuration of support structures formed from any suitable materials, such as a system of elongated support members, a plurality of interconnected panels, or some combination thereof). It should be appreciated that cabinet 110 does not necessarily require an enclosure and may simply include open structure supporting various elements of appliance 100. By contrast, cabinet 110 may enclose some or all portions of an interior of cabinet 110. It should be appreciated that cabinet 110 may have any suitable size, shape, and configuration while remaining within the scope of the present subject matter.

As shown, cabinet 110 extends along the vertical direction V between a top portion 112 and a bottom portion 113; along the lateral direction L between a left side portion 114 and a right side portion 115; and along the traverse direction T between a front portion 116 and a rear portion 117. In some embodiments, cabinet 110 defines multiple discrete cooking chambers, such as a first or left cooking chamber 120 and a second or right cooking chamber 122. Thus, cooking appliance 100 may generally referred to as a double oven range appliance. As will be understood by those skilled in the art, cooking appliance 100 is provided by way of example only, and the present subject matter may be used in any suitable appliance (e.g., a single-chamber oven appliance). Thus, the example embodiments illustrated in the present figures are not intended to limit the present disclosure matter to any particular cooking chamber configuration or arrangement, except as otherwise indicated.

Left and right cooking chambers 120 and 122 are configured for the receipt of one or more food items to be cooked. Heating elements (not shown), such as electric resistance heating elements, gas burners, microwave heating elements, halogen heating elements, or suitable combinations thereof, are positioned within left cooking chamber 120 and right cooking chamber 122 for heating left cooking chamber 120 and right cooking chamber 122.

In the illustrated embodiments, cooking appliance 100 includes a left door 124 and a right door 126 movably (e.g., rotatably) attached to cabinet 110 in order to restrict or permit selective access to left cooking chamber 120 and right cooking chamber 122, respectively. Each door 124, 126 extends (e.g., laterally) between a first side 162 and a second side 164. Since the doors 124, 126 are positioned beside each other, an inner (e.g., laterally inward) side of each door 124 and 126 will thus be disposed proximal or adjacent to each other. In particular, the second side 164 of the first door 124 may be disposed or mounted next to the first side 162 of the second door 126. The outer sides (i.e., the first side 162 of the first door 124 and the second side 164 of the second door 126) are positioned distal to each other and the inner sides, such as at the first side portion 114 and the second side portion 115 of the cabinet 110. Handles 128 are mounted to left and right doors 124 and 126 to assist a user with opening and closing doors 124 and 126 in order to access cooking chambers 120 and 122. As an example, a user can pull on the handle 128 mounted to left door 124 to open or close left door 124 and access left cooking chamber 120. As will be described in greater detail below, glass window panes 130 are provided for viewing the contents of left and right cooking chambers 120 and 122 when doors 124 and 126 are closed and also assist with insulating the cooking chambers 120 and 122.

In optional embodiments, cooking appliance 100 includes a cooktop 140. Cooktop 140 may be positioned at or adjacent to the top portion 112 of cabinet 110. Thus, cooktop 140 is positioned above left and right cooking chambers 120 and 122. Cooktop 140 includes a top panel 142. By way of example, top panel 142 may be constructed of glass, ceramics, enameled steel, and combinations thereof.

For cooking appliance 100, a utensil (not pictured) holding food or cooking liquids (e.g., oil, water, etc.) may be placed onto one or more of burner assemblies 144 (e.g., on a cooking grate). Burner assemblies 144 provide thermal energy to cooking utensils thereon. As shown in FIG. 1, burners assemblies 144 can be configured in various sizes so as to provide for the receipt of cooking utensils (e.g., pots, pans, etc.) of various sizes and configurations and to provide different heat inputs for such cooking utensils.

In some embodiments, user interface or control panel 154 is located within convenient reach of a user of the cooking appliance 100. For some example embodiments, user interface panel 154 includes a front panel 160 disposed on the front portion 116 of cabinet 110. As shown, front panel 160 may be mounted to cabinet 110. Moreover, user interface panel 154 may include one or more knobs 156 that are each associated with one of burner assemblies 144. Knobs 156 allow the user to activate each burner assembly and determine the amount of heat input provided by each burner assembly 144 to a cooking utensil located thereon. User interface panel 154 may also be provided with one or more graphical displays 155 that deliver certain information to the user such as, for example, whether a particular burner assembly is activated or the rate at which the burner assembly is set.

Although shown with knobs 156, it should be understood that knobs 156 and the configuration of cooking appliance 100 shown in FIGS. 1 and 2 is provided by way of example only. More specifically, user interface panel 154 may include various input components, such as one or more of a variety of touch-type controls, electrical, mechanical or electromechanical input devices including rotary dials, push buttons, and touch pads. Optionally, the graphical display 155 may be provided as a touch screen interface configured to receive input commands from a user (e.g., via a capacitive touch panel). Moreover, the user interface panel 154 may include other display components, such as a digital or analog display device designed to provide operational feedback to a user.

Cooking appliance 100 may further equipped with a controller 127 to regulate operation of the cooking appliance 100. For example, controller 127 may regulate the operation of one or more portions of cooking appliance 100, such as the burner assemblies 144, user interface 154, etc. Controller 127 may be in communication (via, for example, a suitable wired or wireless connection) with user interface 154 (e.g., at graphical display 155 or knobs 156). In general, controller 127 may be operable to configure the cooking appliance 100 (and various components thereof) for cooking. Such configuration may be based on a plurality of cooking factors of a selected operating cycles, sensor feedback, etc. By way of example, controller 127 may include one or more memory devices 148 and one or more processors 150, such as general or special purpose microprocessors operable to execute programming instructions or micro-control code associated with an operating cycle. The memory 148 may represent random access memory such as DRAM, or read only memory such as ROM or FLASH. In one embodiment, the processor 150 executes programming instructions stored in memory 148. The memory 148 may be a separate component from the processor 150 or may be included onboard within the processor 150. The memory 148 can store information accessible to processor 150, including instructions that can be executed by processor 150. Optionally, the instructions can be software or any set of instructions that when executed by the processor 150, cause the processor 150 to perform operations. For certain embodiments, the instructions include a software package configured to operate appliance 100 and execute certain tasks.

Controller 127 may be positioned in a variety of locations throughout cooking appliance 100. As an example, one or more portions of controller 127 may be located within a user interface panel 154 of cooking appliance 100. In such an embodiment, input/output ("I/O") signals may be routed between the control system and various operational components of cooking appliance 100 along wiring harnesses that may be routed through cabinet 110. Typically, controller 127 is in communication with user interface panel 154 through which a user may select various operational features and modes and monitor progress of cooking appliance 100. In example embodiments, user interface panel 154 may represent a general purpose I/O ("GPIO") device or functional block.

Turning now to FIGS. 3 through 11, various views are provided to illustrate portions of a door assembly 200 (e.g., movably or rotatably attached to cabinet 110—FIG. 1). Generally, door assembly 200 is described below with respect to the vertical direction V, lateral direction L, and transverse direction T. Although door assembly 200 is movable relative to cabinet 110, it is understood that such descriptions generally relate to door assembly 200 in a closed position, preventing access to a corresponding cooking chamber (e.g., second cooking chamber 122—FIG. 1). For the sake of clarity and efficiency, it is noted that each of FIGS. 3 through 11 may embody or provide a portion of second door 126, as seen in FIGS. 1 and 2. Nonetheless, one of ordinary skill in the art would understood that a similar structure (e.g., mirrored structure which may have one or more different dimensions, such as a different lateral width, and one or more identical dimensions, such as the same vertical height) may be provided for first door 124. For instance, the adjacent or inner portions of the doors 124, 126 may mirror each other. Moreover, the inner side of each door 124 and 126 may be parallel to each other. Advantageously, the mirrored portions of first and second door 124 and 126 may provide a seamless appearance between the two (e.g., while fully supporting a glass panel or otherwise maintaining durability of each door 124 and 126), as shown.

Generally, door assembly 200 extends between a first side 210 and second side 212 (e.g., laterally), between a top end 214 and a bottom end 216 (e.g., vertically), and between a front surface 218 directed away from a corresponding cooking chamber (e.g., second cooking chamber 122—FIG. 1) and a rear surface directed toward the corresponding cooking chamber (e.g., transversely). In some embodiments, door assembly 200 includes a support frame 222 and a front glass panel 224 mounted to support frame 222. Support frame 222 includes a front bezel 226 directed away from the corresponding cooking chamber. Together, front bezel 226 and front glass panel 224 may form at least a portion of the front surface 218 of door assembly 200. Moreover, as would be understood, one or more panels, insulators, or additional glass panels may be provided rearward from front glass panel 224 (e.g., within support frame 222 between the front surface 218 and the rear surface). A door handle 228 may further be attached to the support frame 222, such as at or through the front bezel 226 (e.g., via one or more suitable mechanical fasteners, adhesives, etc.). When assembled, the door handle 228 may be spaced apart from (e.g., disposed above) front glass panel 224.

Front bezel 226 may include or be formed from one or more legs surrounding or framing a central hole 230. For instance, one leg (e.g., vertical leg 232) may extend along the second side 212. Additionally or alternatively, one or more legs (e.g., horizontal legs 234, 236) may extend along top end 214 or bottom end 216. As shown, the legs of front bezel 226 may be discontinuous along at least one side or end such that an opening or gap is defined perpendicular to the central hole 230 (i.e., as radial opening) to form an unenclosed shape, such as the inverse C-shape of the illustrated embodiments.

In some embodiments, a vertical leg 232 of front bezel 226 is generally oriented along or parallel to the vertical direction V. In some embodiments, vertical leg 232 extends between top end 214 and bottom end 216 as a portion of front surface 218 of door assembly 200 at second side 212. A vertical door rim 240 may extend (e.g., directly) from vertical leg 232, such as rearward along the transverse direction T. The vertical door rim 240 at second side 212 may define at least a portion of the lateral periphery or limit of door assembly 200. For instance, the vertical door rim 240 at second side 212 may extend between top end 214 and bottom end 216, connecting discrete top and bottom lateral door rims 242 and 244 (e.g., which define vertical peripheries or limits of door assembly 200).

In certain embodiments, an upper horizontal leg 234 and a separate lower horizontal leg 236 are generally oriented along or parallel to the lateral direction L. As shown, upper and lower horizontal legs 234 and 236 may be spaced apart from each other (e.g., along the vertical direction V). In some such embodiments, upper horizontal leg 234 may be parallel to lower horizontal leg 236. One or both of the horizontal legs 234, 236 may extend along the lateral direction L (e.g., parallel thereto) between the first side 210 and the second side 212. Optionally, vertical door rim 240 may span between or connect upper horizontal leg 234 and lower horizontal leg 236. Additionally or alternatively, a lateral door rim 242, 244 may extend (e.g., directly) from upper or lower horizontal leg 234 or 236, such as rearward along the transverse direction T. A top lateral door rim 242 may define at least a portion of the upper periphery or limit of door assembly 200. A bottom lateral door rim 244 may define at least a portion of the lower periphery or limit of door assembly 200. Separate from or in addition to a vertical door rim 240 at second side 212, a vertical door rim 238 may extend (e.g., directly) from upper horizontal leg 234 or lower horizontal leg 236 at first side 210, such as rearward along the transverse direction T. The vertical door rim 238 at first side 210 may define at least a portion of the lateral periphery or limit of door assembly 200. For instance, the vertical door rim 238 at first side 210 may extend between top end 214 and bottom end 216. Optionally, the vertical door rim 238 at first side 210 may connect upper and lower horizontal legs 234 and 236 or top and bottom lateral door rims 242 and 244.

Rearward from one or more portions of front bezel 226, support frame 222 may include a panel support flange 246. In the illustrated embodiments, panel support flange 246 extends (e.g., in the vertical direction V) along the first side 210. Together, panel support frame 222 and front bezel 226 may define the central hole 230 along the transverse direction T. When assembled, the corresponding cooking chamber (e.g., cooking chamber 122) may thus be visible through the central hole 230.

As shown, panel support flange 246 may further extend (e.g., laterally toward central hole 230) from the vertical door rim 238 at first side 210. In some embodiments, panel support flange 246 is disposed rearward from upper horizontal leg 234 or lower horizontal leg 236. Thus, one or more enlarged endcaps 248 may be formed (e.g., with the vertical door rim 240) at the second side 212. In particular, a discrete enlarged endcap 248 may be formed at upper horizontal leg 234 or lower horizontal leg 236. As shown, each enlarged endcap 248 may extend forward to generally span the transverse distance between panel support flange 246 and upper or lower horizontal leg 234 or 236. When assembled, panel support flange 246 may be disposed rearward from front glass panel 224 (e.g., to brace or support the front glass panel 224 along the transverse direction T).

Front glass panel 224 is generally provided as a planar body (i.e., body defining a planar surface) and may be formed from any suitable transparent or translucent material (e.g., glass, glass ceramic, etc.). As shown, front glass panel 224 may extend (e.g., continuously) between a first panel side 250 and second panel side 252 (e.g., laterally), between a top panel end 254 and a bottom panel end 256 (e.g., vertically), and between a front panel surface and a rear panel surface (e.g., transversely). As noted above, the assembled door assembly 200 provides front glass panel 224 behind (i.e., rearward from) front bezel 226.

Generally, front glass panel 224 has at least one exposed edge 262. The exposed edge 262 may generally occupy or align with a radial opening defined by front bezel 226. In the illustrated embodiments, the exposed edge 262 is defined at first panel side 250. In particular, exposed edge 262 may extend (e.g., vertically) along at least a portion of first side 210. Thus, the exposed edge 262 may be formed as a vertical edge. When assembled, the exposed edge 262 may extend vertically between the upper horizontal leg 234 and the lower horizontal leg 236. Optionally, exposed edge 262 may be flush (e.g., along the transverse direction T) with second side 212 of door assembly 200 (e.g., at the vertical door rim 238 or support frame 222, generally).

As shown, an unexposed edge 264 may further be defined. For instance, unexposed edge 264 may be covered by (e.g., be positioned directly rearward from) a portion of front bezel 226, such as the vertical leg 232. Thus, the unexposed edge 264 may be enclosed and held within support frame 222. Optionally, an unexposed edge 264 may be defined opposite the exposed edge 262. For instance, an unexposed edge 264 may be defined at second panel side 252. In the illustrated embodiments, the unexposed edge 264 at second panel side 252 is covered by the vertical leg 232 of front bezel 226. Additionally or alternatively, multiple unexposed edges 264 may be defined, such as at top panel end 254 and bottom panel end 256 to be covered by upper horizontal leg 234 and lower horizontal leg 236, respectively.

In some embodiments, one or more notches 266, 268 are defined at one or more corners of front glass panel 224. For instance, in the case of a generally rectangular front profile of front glass panel 224, a corner notch 266 or 268 may provide a dogleg or L-shaped void (e.g., cutout) at the location where a lateral side meets a vertical end of front glass panel 224. Such corner notches 266, 268 may extend from the exposed edge 262 (e.g., to an unexposed edge 264). Thus, the exposed edge 262 may be disposed radially outward from a peripheral segment along which the corner notch 266 or 268 is defined.

In the illustrated embodiments, exposed edge 262 is defined along the first panel side 250 while one or more corner notches 266, 268 are defined along an edge spaced apart from first panel side 250. As shown, a top corner notch 266 may extend above the exposed edge 262 (e.g., to top panel end 254). Additionally or alternatively, a bottom corner notch 268 may extend below the exposed edge 262 (e.g., to bottom panel end 256). When assembled, the corner notch(es) 266, 268 may be covered by support frame 222 (e.g., received behind front bezel 226). For instance, top corner notch 266 may be disposed directly behind upper horizontal leg 234. Moreover, top corner notch 266 may receive the upper enlarged endcap 248 (e.g., such that the edge defining top corner notch 266 is abutted against an interior surface of upper enlarged endcap 248). Similarly, bottom corner notch 268 may be disposed directly behind lower horizontal leg 236. Moreover, bottom corner notch 268 may receive the lower enlarged endcap 248 (e.g., such that the edge defining bottom corner notch 268 is abutted against an interior surface of the lower enlarged endcap 248).

As shown, front glass panel 224 may extend across the central hole 230. For instance, front glass panel 224 may extend horizontally (e.g., perpendicular to the transverse direction T) to bisect the axis along which the central hole 230 extends through support frame 222. Thus, when door assembly 200 is closed, a user may look through front glass panel 224 to view the corresponding cooking chamber (e.g., second cooking chamber 122—FIG. 1). Optionally, front glass panel 224 may be secured to an interior surface of support frame 222 or front bezel 226, such as by one or more suitable adhesives or mechanical fasteners disposed between a covered surface of front glass panel 224 and an interior surface of vertical leg 232, upper horizontal leg 234, or lower horizontal leg 236.

Advantageously, oven appliances or door assemblies including one or more of the above described features may create a desirable appearance or easy-to-clean arrange (e.g., while sufficiently supporting glass panel). Additionally or alternatively, multiple doors may advantageously create a visually seamless arrangement for the glass panels of the multiple doors.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance comprising:

a cabinet defining a first cooking chamber and a second cooking chamber spaced apart from the first cooking chamber;

a first door assembly movably mounted to the cabinet to selectively restrict access to the first cooking chamber, the first door assembly extending between an inner side and an outer side and comprising a support frame comprising a front bezel directed forward away from the first and second cooking chambers, and a front glass panel mounted to the support frame behind the front bezel of the first door assembly, the front glass panel of the first door assembly defining an exposed edge along the inner side of the first door assembly, a bottom corner notch extending from the exposed edge of the first door assembly and below the exposed edge as an L-shaped cutout with the exposed edge such that the exposed edge is disposed radially outward from the bottom corner notch, the bottom corner notch being covered by the front bezel of the first door assembly, and a top corner notch extending from the exposed edge of the first door assembly and above the exposed edge as an L-shaped cutout with the exposed edge such that the exposed edge is disposed radially outward from the top corner notch, the top corner notch being covered by the front bezel of the first door assembly; and a second door assembly movably mounted to the cabinet to selectively restrict access to the second cooking chamber, the second door assembly extending between an inner side and an outer side, the inner side of the second door assembly being disposed proximal and parallel to the inner side of the first door assembly, the second door assembly comprising a support frame comprising a front bezel directed forward away from the first and second cooking chambers, and a front glass panel mounted to the support frame behind the front bezel of the second door assembly, the front glass panel of the second door assembly defining an exposed edge along the inner side of the second door assembly, a bottom corner notch extending from the exposed edge of the second door assembly and below the exposed edge as an L-shaped cutout with the exposed edge such that the exposed edge is disposed radially outward from the bottom corner notch, the bottom corner notch being covered by the front bezel of the second door assembly, and a top corner notch extending from the exposed edge of the second door assembly and above the exposed edge as an L-shaped cutout with the exposed edge such that the exposed edge is disposed radially outward from the top corner notch, the top corner notch being covered by the front bezel of the second door assembly.

2. The oven appliance of claim 1, wherein the front bezel of the first door assembly comprises an upper horizontal leg and a lower horizontal leg spaced apart from the upper horizontal leg, wherein the exposed edge of the first door assembly is a vertical edge extending vertically between the upper horizontal leg and the lower horizontal leg of the first door assembly, wherein the front bezel of the second door assembly comprises an upper horizontal leg and a lower horizontal leg spaced apart from the upper horizontal leg, and wherein the exposed edge of the second door assembly is a vertical edge extending vertically between the upper horizontal leg and the lower horizontal leg of the second door assembly.

3. The oven appliance of claim 1, wherein the first door assembly further comprises a first handle attached to the support frame at the front bezel of the first door assembly.

4. The oven appliance of claim 3, wherein the first handle is disposed above and spaced apart from the front glass panel of the first door assembly.

5. The oven appliance of claim 1, wherein the front bezel of the first door assembly comprises a vertical leg extending along the outer side of the first door assembly, wherein the front glass panel of the first door assembly further defines an unexposed edge opposite of the exposed edge of the first door assembly, wherein the unexposed edge of the first door assembly is covered by the vertical leg of the first door assembly, wherein the front bezel of the second door assembly comprises a vertical leg extending along the outer side of the second door assembly, wherein the front glass panel of the second door assembly further defines an unexposed edge opposite of the exposed edge of the second door assembly, and wherein the unexposed edge of the second door assembly is covered by the vertical leg of the second door assembly.

6. The oven appliance of claim 1, wherein the support frame of the first door assembly defines a central hole through which the first cooking chamber may be visible, wherein the front glass panel of the first door assembly extends across the central hole of the first door assembly, wherein the support frame of the second door assembly defines a central hole through which the second cooking chamber may be visible, and wherein the front glass panel of the second door assembly extends across the central hole of the second door assembly.

7. The oven appliance of claim 1, wherein the support frame of the first door assembly comprises a panel support flange disposed behind the front glass panel of the first door assembly along the inner side of the first door assembly, and wherein the support frame of the second door assembly comprises a panel support flange disposed behind the front glass panel of the second door assembly along the inner side of the second door assembly.

* * * * *